US005288422A

United States Patent [19]

Basu et al.

[11] Patent Number: 5,288,422

[45] Date of Patent: Feb. 22, 1994

[54] AZEOTROPE-LIKE COMPOSITIONS OF 1,1,1,3,3,5,5,5-OCTAFLUOROPENTANE, CHLORINATED ETHYLENES, AND OPTIONALLY NITROMETHANE

[75] Inventors: Rajat S. Basu, Williamsville; Ellen L. Swan, Ransomville; David P. Wilson, East Amherst, all of N.Y.

[73] Assignee: AlliedSignal Inc., Morris Township, Morris County, N.J.

[21] Appl. No.: 31,740

[22] Filed: Mar. 15, 1993

[51] Int. Cl.[5] ..... C11D 7/30; C11D 7/50; C23G 5/028

[52] U.S. Cl. ..... 252/172; 134/12; 134/31; 134/38; 134/40; 134/42; 252/153; 252/162; 252/364; 252/DIG. 9; 8/142

[58] Field of Search ..... 252/153, 162, 172, 364, 252/DIG. 9; 134/38, 40, 42, 12, 31; 8/142

[56] References Cited

U.S. PATENT DOCUMENTS 3,927,129 12/1975 Haszeldine et al. ..... 260/653.1 R
5,171,902 12/1992 Krespan et al. ..... 570/175
5,196,137 3/1993 Merchant ..... 252/172

FOREIGN PATENT DOCUMENTS 0431458 6/1991 European Pat. Off. .
3-252500 11/1991 Japan ..... 252/171
4-346946 12/1992 Japan .

OTHER PUBLICATIONS

F. A. Bloshcitsa et al., "Reaction of Hydroxy- and Carbonyl Compounds with Sulfur Tetrafluoride, XIV. Reaction of Aliphatic Oxocarboxylic Acids with $SF_4$", Zh. Org. Khim. vol. wl, No. 7, pp. 1414–1420 (1985).

*Primary Examiner*—Linda Skaling
*Attorney, Agent, or Firm*—Colleen D. Szuch; Jay P. Friedenson

[57] ABSTRACT

Azeotrope-like compositions comprising 1,1,1,3,3,5,5,5-octafluoropentane, chlorinated ethylene and optionally nitromethane have been discovered which are stable and have utility as degreasing agents and as solvents in a variety of industrial cleaning applications including cold cleaning and defluxing of printed circuit boards and dry cleaning.

10 Claims, No Drawings

AZEOTROPE-LIKE COMPOSITIONS OF 1,1,1,3,3,5,5,5-OCTAFLUOROPENTANE, CHLORINATED ETHYLENES, AND OPTIONALLY NITROMETHANE

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Cold cleaning is another application where a number of solvents are used. In most cold cleaning applications, the soiled part is either immersed in the fluid or wiped with cloths or similar objects soaked in solvents and allowed to air dry.

Azeotropic or azeotrope-like compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity.

Fluorocarbon solvents, such as trichlorotrifluoroethane (CFC-113), have attained widespread use in recent years as effective, nontoxic, and nonflammable agents useful in degreasing applications and other solvent cleaning applications. The art has looked towards azeotrope or azeotrope-like compositions which include fluorocarbon components such as CFC-113 and also include components which contribute additionally desired characteristics, such as polar functionality, increased solvency power, and stabilizers.

The art is continually seeking new fluorocarbon-based azeotrope-like mixtures which offer alternatives for new and special applications for vapor degreasing and other cleaning applications. Currently, fluorocarbon, hydrofluorocarbon, and hydrochlorofluorocarbon based azeotrope-like mixtures with minimal or no chlorine are of particular interest because they are considered to be stratospherically safer substitutes for presently used chlorofluorocarbons (CFCs). CFC's like CFC-113 are suspected of causing environmental problems in connection with the earth's protective ozone layer. Mathematical models have substantiated that hydrofluorocarbons, such as 1,1,1,3,3,5,5,5-octafluoropentane (known in the art as HFC-458mfcf), will not adversely affect atmospheric chemistry, since it is non-ozone depleting and contributes negligibly to global warming.

DESCRIPTION OF THE INVENTION

Our solution to the need in the art for substitutes for chlorofluorocarbon solvents is mixtures comprising 1,1,1,3,3,5,5,5-octafluoropentane (HFC-458mfcf), chlorinated ethylenes, and optionally nitromethane.

For purposes of this invention, chlorinated ethylenes shall mean perchloroethylene and trichloroethylene.

The present azeotrope-like compositions are advantageous for the following reasons. The HFC-458mfcf component does not contribute to ozone depletion and has reasonable solvency characteristics. The trichloroethylene or perchloroethylene components also have good solvent properties dissolving polar and non-polar soils including soils in garments to be dry cleaned. Nitromethane is used to inhibit the decomposition of both HFC-458mfcf and the chlorinated solvents. Thus, when these components are combined in effective amounts, an efficient azeotrope-like solvent results.

The preferred, more preferred and most preferred embodiments for each azeotrope-like composition of the invention are listed in Table I. The proportions/ranges listed in the Table are understood to be prefaced by "about".

TABLE 1

| COMPONENTS | PREFERRED RANGE (WT. %) | MORE PREFERRED RANGE (WT. %) | MOST PREFERRED RANGE (WT. %) | BOILING POINT (°C.) (760 mmHg) |
|---|---|---|---|---|
| HFC-458mfcf | 90–48 | 86.5–59.5 | 78.7–69.3 | 66.4 ± 1.0 |
| Trichloroethylene | 10–50 | 13.5–40.5 | 22.7–30.2 | |
| Nitromethane | 0–2 | 0–1 | 0–0.5 | |
| HFC-458mfcf | 99.5–83.8 | 97.5–89.7 | 94.9–92.1 | 71.1 ± 1.0 |
| Perchloroethylene | 0.5–15.2 | 2.5–9.3 | 5.1–7.4 | |
| Nitromethane | 0–2 | 0–1 | 0–0.5 | |

All compositions within the indicated ranges, as well as certain compositions outside the indicated ranges, are azeotrope-like, as defined more particularly below.

The precise azeotropic compositions have not been determined but have been ascertained to be within the above ranges. Regardless of where the true azeotropes lie, all compositions with the indicated ranges, as well as certain compositions outside the indicated ranges, are azeotrope-like, as defined more particularly below.

It has been found that some of these preferred azeotrope-like compositions with HFC-458mfcf are nonflammable, i.e. they exhibit no flash point when tested by the Tag Open Cup test method - ASTM D 1310-86 and Tag Closed Cup Test Method - ASTM D 56-82. This is advantageous because these mixtures will not require explosion proof equipment in the degreasers in which they are used. The flammable azeotrope-like compositions of the invention may be used in cold cleaning or specialty cleaning applications where flammability is not a concern.

The term "azeotrope-like" as used herein is intended to mean that the composition behaves like an azeotrope, i.e., has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is contrasted with non-azeotrope-like compositions in which the liquid composition changes substantially during boiling or evaporation.

As is readily understood by persons skilled in the art, the boiling point of the azeotrope-like composition will vary with the pressure.

The azeotrope-like compositions of the invention are useful as solvents in a variety of vapor degreasing, cold cleaning and solvent cleaning applications including defluxing and dry cleaning.

In the process embodiment of the invention, the azeotrope-like compositions of the invention may be used to clean solid surfaces by treating said surfaces with said compositions in any manner well known in the art such as by dipping or spraying or use of conventional degreasing apparatus.

HFC-458mfcf is not commercially available. It may be prepared by following the synthesis disclosed in F. A. Bloshchitsa, A. I. Burmakov, B. V. Kunshenko, L. A. Alekseeva and L. M. Yugopolski, "Reaction of hydroxy and carbonyl compounds with sulfur tetrafluoride. XIV. Reaction of aliphatic oxocarboxylic acids with $SF_4$", Zh. Org. Khim., Vol 21, no 7, 1985, pp 1414–20 (English translation can be found in Russian Journal of Organic Chemistry, Vol 21, no 7, 1985, pp 1286–1291). Other methods for the preparation of HFC-458mfcf will readily occur to those skilled in the art.

The perchloroethylene and trichloroethylene components and nitromethane are known materials and are commercially available.

EXAMPLES 1 AND 2

The range over which the following compositions exhibit constant boiling behavior was determined using ebulliometry.

a) HFC-458mfcf/trichloroethylene and;

b) HFC-458mfcf/perchloroethylene.

The ebulliometer used in this experiment consisted of a heated sump. The upper part of the ebulliometer connected to the sump was cooled thereby acting as a condenser for the boiling vapors, allowing the system to operate at total reflux. Measured quantities of HFC-458mfcf were charged into the ebulliometer and brought to a boil. Then, measured amounts of the chlorinated ethylene were titrated into the ebulliometer. The change in boiling point was measured with a platinum resistance thermometer.

The results indicate that the following compositions are azeotropic or constant boiling at the stated temperatures at 760 mm Hg:

a) about 90–50/10–50 weight percent HFC-458mfcf/trichloroethylene at about 66.4° C.;

b) about 99.5–83.8/0.5–16.2 weight percent HFC-458mfcf/perchloroethylene at about 71.1° C.

EXAMPLES 3 AND 4

The experiment outlined in Examples 1 and 2 above is repeated for the following compositions:

a) HFC-458mfcf/trichloroethylene/nitromethane; and b) HFC-458mfcf/perchloroethylene/nitromethane except that in the case of composition a) trichloroethylene and HFC-458mcfc were both initially charged to the ebulliometer and then measured amounts of nitromethane were subsequently added and in the case of composition b) HFC-458mcfc and nitromethane were both initially charged to the ebulliometer and measured amounts of perchloroethylene added.

The results indicate that the following compositions are azeotropic or constant boiling at the stated temperatures at 760 mm Hg:

a) 90–48/10–50/0.5–2 weight percent HFC-458mfcf/trichloroethylene/nitromethane respectively at about 66.4° C.; and b) 99.5–83.8/0.5–15.2/0.5–2 weight percent HFC-458mfcf/perchloroethylene/nitromethane respectively at about 71.1° C.

EXAMPLES 5 THROUGH 8

Performance studies were conducted wherein metal coupons were cleaned using the present azeotrope-like compositions as solvents. The metal coupons were soiled with various types of oils and dried so as to partially simulate conditions which occur while machining and grinding in the presence of these oils.

A test tube with condensing coils near its lips was used in this experiment. Each azeotrope-like composition was boiled in the test tube and condensed on the coils providing adequate vapor. The condensed solvent dripped back into the test tube.

The metal coupons were held in the solvent vapor and then vapor rinsed for a period of 15 seconds to 2 minutes depending upon the oils selected. The azeotrope-like compositions of Examples 1 through 4 were used as the solvents. Cleanliness (i.e. total residual materials left after cleaning) of the coupons was determined by measuring the weight change of the coupons using an analytical balance. The results indicate that the compositions of Examples 1 through 4 are effective solvents, removing substantially all of the soil from the coupons.

EXAMPLES 9 THROUGH 12

Each solvent of Examples 1 through 4 above is added to mineral oil in a weight ratio of 50:50 at 25° C. Each solvent is miscible in the mineral oil.

Known additives may be used in the present-azeotrope-like compositions in order to tailor the composition for a particular use. Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art. The inhibitors may be used alone or as mixtures in any proportion. Typically, up to about 2 percent of inhibitor based on the total weight of the azeotrope-like composition may be used.

In spraying applications, the azeotrope-like compositions may be sprayed onto a surface by using a propellant. Suitable propellants include chlorofluorocarbons like dichlorodifluoromethane, hydrochlorofluorocarbons like chlorodifluoromethane, hydrofluorocarbons like 1,1,1,2-tetrafluoroethane, ethers like dimethyl ether and hydrocarbons like butane and isobutane.

What is claimed is:

1. Azeotrope-like compositions consisting essentially of from about 90 to about 48 weight percent 1,1,1,3,3,5,5,5-octafluoropentane, from about 10 to about 50 weight percent trichloroethylene and from about 0 to about 2 weight percent nitromethane which boil at about 66.4° C. at 760 mm Hg; or from about 99.5 to about 83.8 weight percent 1,1,1,3,3,5,5,5-octafluoropentane, from about 0.5 to about 15.2 weight percent perchloroethylene and from about 0 to about 2 weight percent nitromethane which boil at about 71.1° C. at 760 mm Hg.

2. The azeotrope-like compositions of claim 1 wherein said compositions of 1,1,1,3,3,5,5,5-octafluoropentane, trichloroethylene and optionally nitromethane boil at 66.4° C. ± about 1° C. at 760 mm Hg.

3. The azeotrope-like compositions of claim 1 wherein said compositions consist essentially of from about 86.5 to about 59.5 weight percent 1,1,1,3,3,5,5,5-octafluoropentane, from about 13.5 to about 40.5 weight percent trichloroethylene and from about 0 to about 1 weight percent nitromethane.

4. The azeotrope-like compositions of claim 1 wherein said compositions consist essentially of from about 78.7 to about 69.3 weight percent 1,1,1,3,3,5,5,5-octafluoropropane, from about 22.7 to about 30.2 weight percent trichloroethylene and from about 0 to about 0.5 weight percent nitromethane.

5. The azeotrope-like compositions of claim 1 wherein said compositions of 1,1,1,3,3,5,5,5-octafluoropentane, perchloroethylene and optionally nitromethane boil at 71.1° C. ± about 1.0° C. at 760 mm Hg.

6. The azeotrope-like compositions of claim 1 wherein said compositions consist essentially of from about 97.5 to about 89.7 weight percent 1,1,1,3,3,5,5,5-octafluoropentane, from about 2.5 to about 9.3 weight percent perchloroethylene and from about 0 to about 1 weight percent nitromethane.

7. The azeotrope-like compositions of claim 1 wherein said compositions consist essentially of from about 94.9 to about 92.1 weight percent 1,1,1,3,3,5,5,5-octafluoropentane, from about 5.1 to about 7.4 weight percent perchloroethylene and from about 0 to about 0.5 weight percent nitromethane.

8. The azeotrope-like compositions of claim 1 wherein an effective amount of an inhibitor is present to accomplish at least one of the following: inhibit decomposition of the compositions; react with undesirable decomposition products of the compositions; and prevent corrosion of metal surfaces.

9. The azeotrope-like compositions of claim 8 wherein said inhibitor is selected from the group consisting of alkanols having 4 to 7 carbon atoms, 1,2-epoxyalkanes having 2 to 7 carbon atoms, phosphite esters having 12 to 30 carbon atoms, acetals having 4 to 7 carbon atoms, ketones having 3 to 5 carbon atoms, and amines having 6 to 8 carbons atoms.

10. A method of cleaning a solid surface comprising treating said surface with an azeotrope-like composition of claim 1.

* * * * *